US010272469B2

(12) United States Patent
Landa et al.

(10) Patent No.: US 10,272,469 B2
(45) Date of Patent: Apr. 30, 2019

(54) PROCESS FOR METALLISING A POLYMERIC SURFACE

(71) Applicant: LANDA LABS (2012) LTD., Rehovot (IL)

(72) Inventors: Benzion Landa, Nes Ziona (IL); Anton Krassilnikov, Durham, NH (US); Sagi Abramovich, Ra'anana (IL); Tamar Asher, Tel Aviv (IL)

(73) Assignee: LANDA LABS (2012) LTD., Rehovot (IL)

( * ) Notice: Subject to any disclaimer, the term of this patent is extended or adjusted under 35 U.S.C. 154(b) by 0 days.

(21) Appl. No.: 15/571,855

(22) PCT Filed: May 27, 2016

(86) PCT No.: PCT/IB2016/053144

§ 371 (c)(1),
(2) Date: Nov. 6, 2017

(87) PCT Pub. No.: WO2016/189514

PCT Pub. Date: Dec. 1, 2016

(65) Prior Publication Data

US 2018/0133753 A1 May 17, 2018

(30) Foreign Application Priority Data

May 27, 2015 (GB) ..... 1509082.2
Feb. 10, 2016 (GB) ..... 1602420.0

(51) Int. Cl.
*B05D 3/12* (2006.01)
*B05D 5/06* (2006.01)
(Continued)

(52) U.S. Cl.
CPC ..... *B05D 5/068* (2013.01); *B05D 3/12* (2013.01); *B05D 5/06* (2013.01); *B05D 5/063* (2013.01);
(Continued)

(58) Field of Classification Search
CPC . B05D 3/12; B05D 5/06; B05D 5/063; B05D 5/067; B05D 5/068; B05D 7/02;
(Continued)

(56) References Cited

U.S. PATENT DOCUMENTS

2005/0244584 A1* 11/2005 Afshar ..... B05D 5/068 427/407.1
2010/0208351 A1* 8/2010 Nofi ..... B05D 3/12 359/589
2014/0127829 A1 5/2014 Baumberg et al.

FOREIGN PATENT DOCUMENTS

EP 1359792 A1 11/2003
WO 2012156728 A 11/2012
WO WO-2012156728 A1 * 11/2012 ..... G01B 11/16

OTHER PUBLICATIONS

International Search Report for PCT/IB2016/053144 dated Sep. 15, 2016.

(Continued)

*Primary Examiner* — William P Fletcher, III
(74) *Attorney, Agent, or Firm* — Marc Van Dyke; Fourth Dimension IP

(57) ABSTRACT

A process for metallising a polymeric surface of an article, the process including applying to the polymeric surface a liquid carrier containing a suspension of metallic or metal-looking particles, wherein the polymeric surface and the liquid carrier are such that the wetting angle between the liquid carrier and the polymeric surface is of substantially 90° or above, and wherein the particles and the polymeric surface are such that the particles have a greater affinity to
(Continued)

the polymeric surface than to one another or to the liquid, whereby particles suspended in the liquid migrate to the interface between the liquid and the polymeric surface to form a monolayer coating of particles on the polymeric surface.

20 Claims, 2 Drawing Sheets

(51) Int. Cl.

| | |
|---|---|
| ***B05D 7/00*** | (2006.01) |
| ***B05D 7/02*** | (2006.01) |
| ***B44C 1/00*** | (2006.01) |
| ***B44F 9/10*** | (2006.01) |

(52) U.S. Cl.
CPC ..... *B05D 5/067* (2013.01); *B05D 7/02* (2013.01); *B05D 7/52* (2013.01); *B05D 7/53* (2013.01); *B05D 7/5483* (2013.01); *B44C 1/00* (2013.01); *B44F 9/10* (2013.01); *B05D 2201/02* (2013.01); *B05D 2601/02* (2013.01)

(58) Field of Classification Search
CPC ..... B05D 7/52; B05D 7/53; B05D 7/5483; B05D 2201/02; B05D 2601/02
See application file for complete search history.

(56) References Cited

OTHER PUBLICATIONS

Written Opinion for PCT/IB2016/053144 dated Sep. 15, 2016.
Machine Translation (by EPO and Google) for EP1359792 published on Nov. 5, 2003.

* cited by examiner

PROCESS FOR METALLISING A POLYMERIC SURFACE

FIELD

The present invention relates to a process for metallising a surface, that is to say imparting a metallic appearance to the surface.

BACKGROUND

There are numerous occasions where one may wish to at least partly metallise a surface of an article primarily for aesthetic reasons. For example, one may wish a selected surface of an article moulded from a plastic material to have a mirror or satin-chrome finish, in order to give an impression of solidity and high quality. Processes for achieving such goal may be of use in a wide range of industries, and on various types of surfaces in addition to plastics, and could serve for automotive coatings, architectural goals and the metallisation of objects such as appliances, furniture, kitchenware, decorative items etc.

Hitherto, such metallisation has been achieved by electroless plating or in some cases by hot or foil blocking.

SUMMARY

According to the present disclosure, there is provided a process for metallising a polymeric surface of an article, which process comprises applying to the polymeric surface a liquid carrier containing a suspension of metallic or metal-looking particles, wherein the polymeric surface and the liquid carrier are such that the wetting angle between the liquid carrier and the polymeric surface is of substantially 90° or above and wherein the particles and the polymeric surface are such that the particles have a greater affinity to the polymeric surface than to one another or to the liquid, whereby particles suspended in the liquid migrate to the interface between the liquid and the polymeric surface to form a monolayer coating of particles on the polymeric surface.

The application of the suspended particles to the polymeric surface is a direct one. That is to say no wetting layers are necessary to facilitate the coating. The present process is in particular devoid of a wetting layer including, consisting or consisting essentially of an organic solvent, and more so of a volatile solvent.

The particles may be of a metal, such as aluminum, copper, gold, iron, nickel, tin, titanium, silver and zinc, or of an alloy, such as steel, brass and bronze, but other materials, such as polymeric or ceramic material that have metal-like reflectivity, such as mica compounds (typically coated with metal oxides), may alternatively be used. Such particles may be referred to as metallic, if made of such materials, or metal-looking particles, when providing the appearance of metallic compounds (i.e., enabling any visual effect real metals can offer).

The particles can have any shape suitable for the visual effect to be imparted. Preferred shapes and/or dimensions provide for sufficient contact area with the polymeric surface, at least over a time period the visual effect is desired or until an overcoat is applied.

The particles can be approximately spherical (e.g., having a mean diameter of up to 10 micrometers, or even of 1 μm and less), but are preferably shaped as flat platelets, that is to say having a thickness that is significantly (for example five, ten, twenty, or even a hundred times) smaller than their representative planar dimension (e.g., mean diameter for near round flakes or average "equivalent diameter" for platelets having less regular plane projection, also characterized by shortest/longest dimensions). The longest dimension of irregular platelets typically does not exceed 100 μm on average. Platelets having an aspect ratio of up to 1:500 may also be suitable, and it is believed that such particles may even be generated during an optional burnishing step to be described below.

Depending on the visual effect to be imparted, particles having a thickness of up to 1 μm can be used in the process. It is preferred that the particles should have a thickness of only a few, or a few tens of, nanometers so that they may closely follow the contour of the surface onto which they are applied and thereby retain substantially the same surface roughness. Thus, if the surface to be coated is polished to a high gloss, the metal particle coating will result in a mirror-like finish whereas a satin finish would result from coating a surface of greater roughness. Metallic or metal-looking particles having a thickness between about 10 nm and 600 nm are suitable, particles having a thickness between about 20 nm and 500 nm or even 400 nm being typically appropriate.

The particles can, but need not necessarily, be coated further. The coating of the particles, which can be applied by physical but more typically chemical means, may, among other things, reduce or prevent the particles sticking to one another (e.g., as achievable with anti-caking agents and the like), increase the repulsion between the particles (e.g., as achievable by increasing the charge of the particles), protect the particles from undesired chemical modification (e.g., reduce, prevent or delay the oxidation of metals and alloys or any other deleterious aging of the metal-looking particles) or further increase the affinity of the particles to the polymeric surface (including to the base coat, if relevant).

As hydrophobic particles are preferred for the present process, a coating can be applied to the particles to render them hydrophobic or to further increase their inherent hydrophobicity. Materials suitable for such a particle coating can have a hydrophilic end with affinity to the particle (e.g., a carboxylic function affine to a metal oxide) and a hydrophobic tail.

In the present disclosure such particles, whether intrinsically hydrophobic or coated to become hydrophobic or more hydrophobic, are said to be substantially hydrophobic.

In one embodiment, the particles are of aluminum and are coated with a carboxylic acid (e.g., a fatty acid) which render the particles hydrophobic, reduce their ability to stick to one another and reduce their oxidation.

In some situations, the surface to be metallised, may be that of an article that has been moulded from an appropriate polymeric material. In such a case, the surface need not undergo any special preparation steps. In all situations, in particular where the article surface is not made of a suitable polymeric material, a polymeric base coat may be applied to the article, prior to the surface being coated with metallic or metal-looking particles. The base coat may be applied in any suitable manner, such as spraying, brushing, dipping etc. Though for environmental and health reasons, most industries prefer to use aqueous vehicles for such base coats, the polymeric base coat can be applied in any carrier compatible with the polymers and optional additives it may contain and with the surface to be coated.

The liquid carrier of the metallic or metal-looking particles may suitably be an aqueous carrier (e.g., comprising at least 75% water per total weight of the composition) and the polymeric surface, whether of the article or of the base coat, may be selected to be hydrophobic so that the liquid does not wet the polymeric surface and only the particles adhere to the polymeric surface to form a mosaic of individual particles sufficient to achieve the desired visual effect. The liquid carrier, and any additive therein, are preferably "inert" with respect to the polymeric surface, that is to say they would not cause a deleterious effect that would prevent the desired end result. For example, the liquid carrier preferably cannot swell the polymeric surface.

For a relatively light effect or matte appearance, the area coverage by the mosaic of particles can be smaller than for glossy or mirror-like appearance. For such high gloss visual appearance, the mosaic of particles can cover substantially the whole of the selected surfaces of the articles to be coated. By "substantially" covering, it is meant that the coat of particles on the relevant surface of the article will be devoid of visible defects, such as discontinuities or holes in the mosaic of particles that would expose the polymeric surface. Having at least 80% of the area of the surface to be coated by particles, or at least 85%, or at least 90%, or at least 95% or at least 99% of the area covered by particles is considered a substantial coverage.

The liquid carrier of the metallic or metal-looking particles can further comprise, in addition to water, co-solvents, stabilizers, dispersants, pH modifying agents, preservatives and like agents commonly used in the formulation of dispersions. The liquid carrier may also comprise excess of unbound material serving as particle coat. All such additives and their typical concentrations are known to persons skilled in the art of dispersions and need not be further detailed herein. Additives (or mixtures thereof) not affecting the hydrophobicity of the particles and the polymeric surface are preferred. Furthermore, any such additive and mix thereof, preferably do not affect the overall inertness of the liquid carrier towards the polymeric surface (e.g., avoiding or reducing any deleterious swelling of the surface that would prevent proper attachment of the particles).

Without wishing to be bound by any particular theory, it is believed that alternatively, and additionally to hydrophobic-hydrophobic interactions, the relative affinity of the particles to the polymeric surface can be facilitated by each having opposite charges. The polymeric surface can therefore have any charge that would be compatible with the intended particles. If not inherent to the polymers forming the surface, such charge can be tailored by an appropriate surface treatment (e.g., plasma treatment) or inclusion of suitable chemical additives to the polymeric surface or base coat.

The polymeric surface to be coated may comprise a polymer or co-polymer (or mixture thereof) inherently hydrophobic or supplemented to be hydrophobic (or more hydrophobic) by a "hydrophobicity additive" to be discussed below. In some embodiments, the polymeric material may be a polyurethane, a polyurethane-silicone copolymer, a polyester or an acrylic polymer. Additives that may promote the hydrophobicity of a polymeric composition may be, for example, oils (e.g., synthetic, natural, plant or mineral oils), waxes, plasticizers and silicone additives. Such hydrophobicity additives can be compatible with any polymeric material, as long as their respective chemical nature or amounts do not prevent proper formation of the base coat, and for instance would not impair adequate curing of the polymeric material. A proper base coat would typically form a continuous film on the surface to be coated with the particles, the article and the base coat having respective surface energies suitable for such uniform wetting. However, "orange peel" coatings may suit certain visual effects not requiring maximum mirror-like appearance. In addition to being compatible with the substrate, the base coat needs to be suitable for the intended particles. When the polymeric surface is provided by the application of a base coat, this polymeric composition should preferably be such that the resulting base coat is on one hand sufficiently "soft" to enable enough contact with the particles. On the other hand, the base coat need preferably be sufficiently "hard" to resist burnishing, if such a step is required to achieve the desired visual effect.

It will be appreciated that the relative softness or hardness of the polymeric surface can also, in some cases, affect the resulting visual effect. It is believed that particles applied on a harder surface have typically an increased tendency to be oriented parallel to the surface than particles applied to a softer surface. Thus, harder surfaces may enable glossier effects than relatively softer surfaces, which in extreme cases may only provide for a matte effect.

The composition of the base coat, if required to be applied to the surface of the article, preferably does not interfere with the desired visual effect (e.g., the dried coat can be clear, transparent, and/or colorless). The base coat can be a curable composition, optionally partially cured to achieve desired compatibilities and interactions with the article and with the particles. Following the application of the particles, the base coat can be cured to secure the attachment of the particles thereto. Such curing can be performed by heat or radiation, as appropriate for the type of curable formulation. Additionally, such a curing step, if necessary can either precede or follow a burnishing step, if present. As mentioned, the resulting layer of particles can be further overcoated, if desired.

In the event a base coat is necessary, it can be applied to the article according to a desired pattern. In such case, metallized pattern(s) can be created at predetermined locations on the surface of the article providing for partial coating.

The liquid carrier comprising the particles (e.g., whether shaped as spheres or lamellar platelets, and coated or uncoated hydrophobic elements) may be applied to the base coat by any suitable manner such as spraying, dipping, brushing, wiping or rolling. Such methods of applying the particles generally results in the particles being suspended in the liquid carrier under a relatively turbulent regime. Moreover, the time window between the application of the particles and the formation of the monolayer coating is typically short. It is therefore very unlikely that particles would undergo any leafing (i.e. migrating towards the interface between the liquid and the ambient air) during the performance of the present process, especially taking into account their preferred affinity towards the polymeric surface. As a result of such considerations, the particles applied according to the present teachings are viewed as migrating towards the interface between the polymeric surface and the liquid.

It is preferred that the application should tend to homogeneously distribute and/or flatten the particles against the surface to be coated and also to burnish the surface while removing platelets that are not directly adhered to or in direct contact with the polymeric surface.

Because the particles do not tend to stick to one another (either intrinsically or as a result of a particle coat) and only adhere to the polymeric surface, they will only form a monolayer coating though there may be regions where the edge one particle overlies the edge of an adjacent particle. If the coating is burnished, either during or subsequent to application, then within any such regions where particles are one on another, the burnishing action will tend to break off parts of particles that are not directly adhered to the polymeric substrate and will also flatten the particles against the surface to reproduce the same surface roughness or finish as that of the underlying polymeric surface. As mentioned, such breaking down of the particles as a result of the burnishing process may lead to some modifications of their dimensions, and predominantly of their aspect ratio. For instance, a platelet having a thickness of 20 nm and a representative planar dimension of 10 μm (aspect ratio 1:500), may be broken down during application or further flattening to platelet fragments of similar thickness, but having a planar dimension of only 2 μm or less (aspect ratio≤1:100). Burnishing is expected to facilitate the parallel orientation of the flake-like particles to the substrate. It may additionally ensure an even coverage of the target surface, reducing the occurrence or areas of interstices, such voids being filled in by the loosely attached particles or fragments thereof being displaced during such a step.

After application in the manner described above, the particle coating, also referred to herein as the particle layer, may form a mosaic of particles, which when shaped as platelets can have their plane oriented substantially parallel to the polymeric surface.

The particle layer may be protected by application of a transparent varnish which may itself contain a colorant. In this way, a clear colored varnish applied to a coating of aluminum particles may result, for example, in a gold or copper appearance.

BRIEF DESCRIPTION OF THE DRAWINGS

Some embodiments of the disclosure will now be described further, by way of example, with reference to the accompanying figures. The description, together with the figures, makes apparent to a person having ordinary skill in the art how some embodiments of the disclosure may be practiced. The figures are for the purpose of illustrative discussion and no attempt is made to show structural details of an embodiment in more detail than is necessary for a fundamental understanding of the disclosure. For the sake of clarity and convenience of presentation, some objects depicted in the figures are not necessarily shown to scale.

In the Figures.

DETAILED DESCRIPTION

Figure 1:
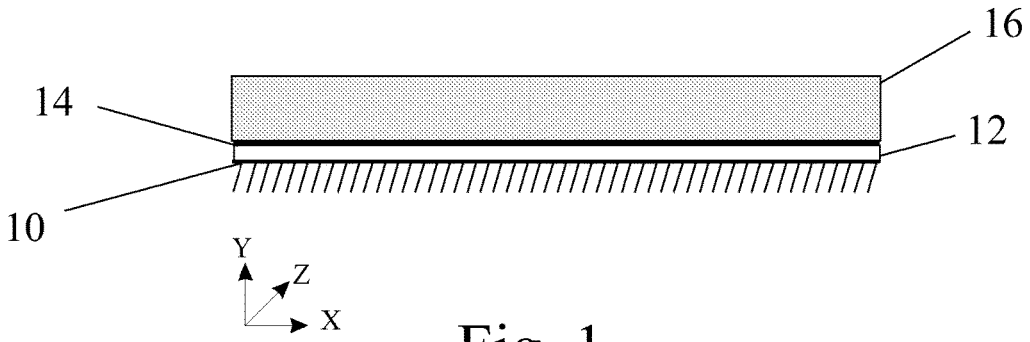
FIG. 1 is a section through a surface which has been metallised according to the present teachings.
Figure 2:
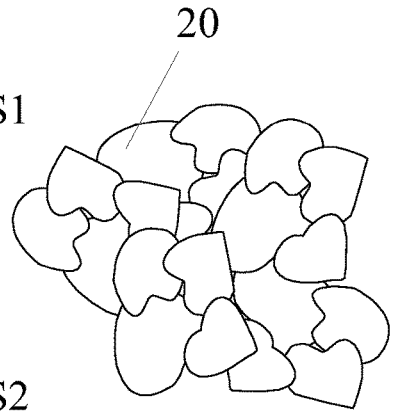
FIG. 2 is a schematic, greatly magnified, plan view of the particle layer of FIG. 1.

FIG. 1 shows a section through an article having a surface 10 which has been metallised. The surface 10, if not itself made of a suitable polymer, is coated with a polymeric base coat 12. A particle layer 14 formed of a mosaic of metal or metal-looking particles 20, as shown from a top view in FIG. 2, is applied to the base coat 12 and a protective varnish 16 can be applied over the particles layer 14.

Figure 4A:
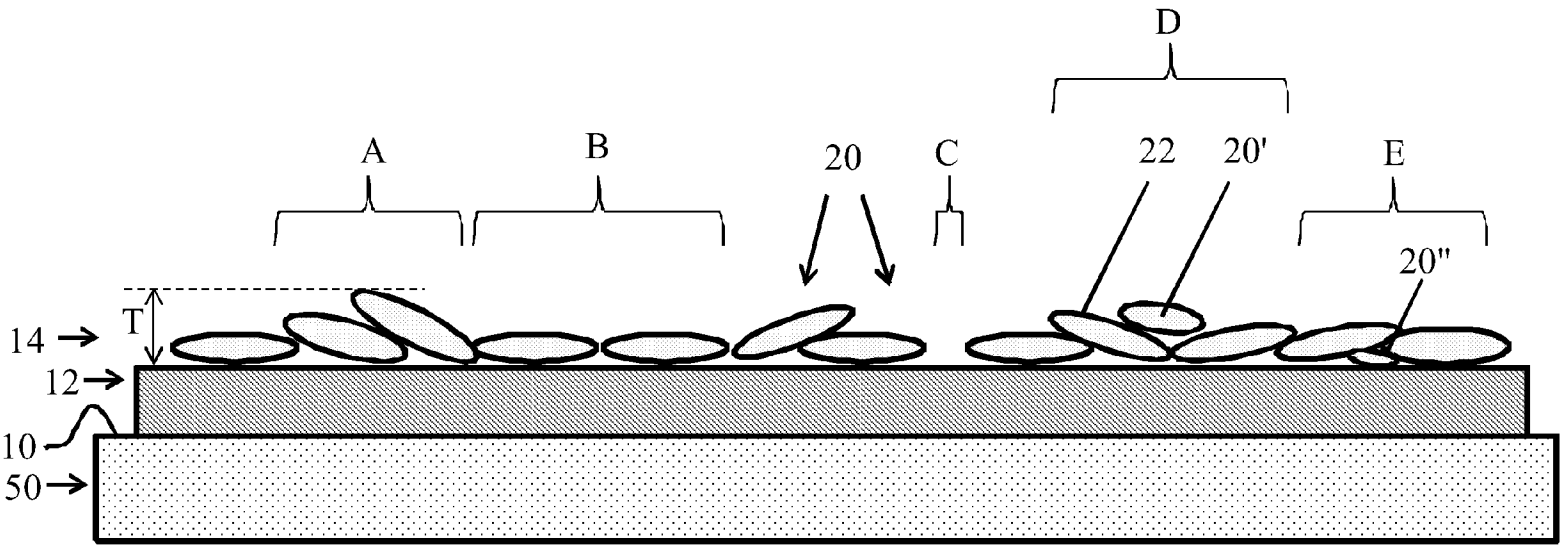
FIGS. 4A and 4B schematically illustrate a section through a polymeric substrate as can be coated according to the present teachings.
Figure 4B:
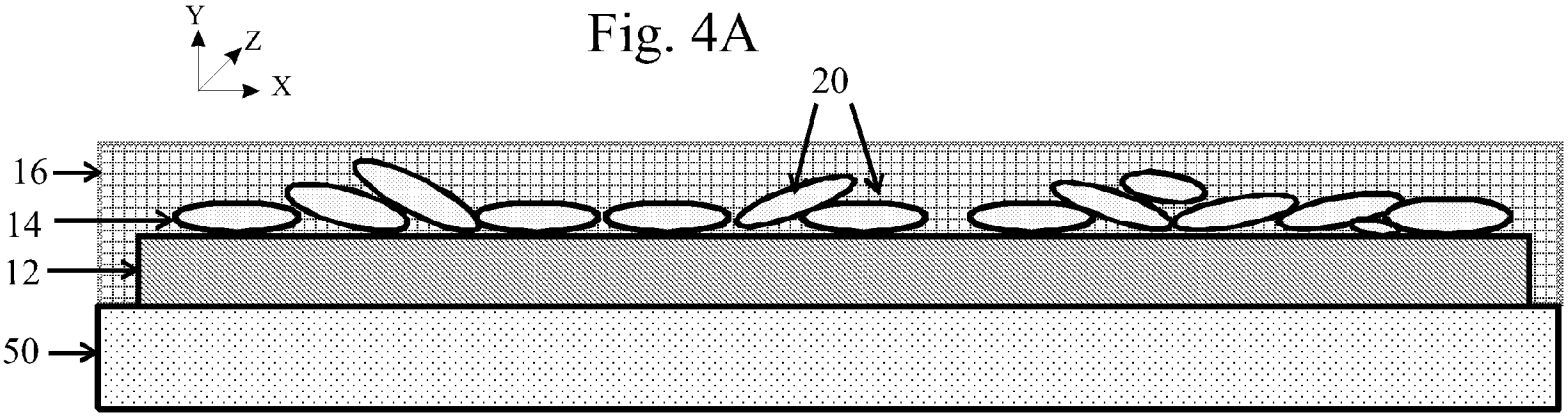

Magnified views of such sections are schematically illustrated in FIGS. 4A and 4B. While particles 20, as illustrated, have an elongated shape, this should not be construed as limiting. Particles 20 are positioned in the present illustration on top of a base coat 12, itself selectively applied upon a article substrate 50 having an outer surface 10. Such arrangement of the particles, which as mentioned may be formed directly on surface 10 if a suitable polymeric surface, results in a monolayer 14 of particles 20. As previously explained, the outer surfaces 22 of particles 20 can be hydrophobic.

Referring to FIG. 4A, several particles are shown to be partially overlapping, see section A, such overlap yielding an overall particle layer thickness denoted as T. In section B, the particles are illustrated as being contiguous, whereas section C points to a gap between neighboring particles. In section D, a particle 20' is shown as having no contact with the base coat, as appearing in the present x-y-cross section. However, such an overlapping particle may be positioned over the particles contacting the underneath layer such that it could conceivably contact the base coat (or the article surface, as the case may be) at another point (not shown) along the z-direction. In section E, a particle 20" is shown as being overlapped by more than one adjacent particle, all directly contacting the underneath layer. FIG. 4B illustrates an alternative embodiment, wherein, as illustrated the monolayer 14 of particles is further coated with an overcoat 16, as previously illustrated in FIG. 1.

Figure 3:
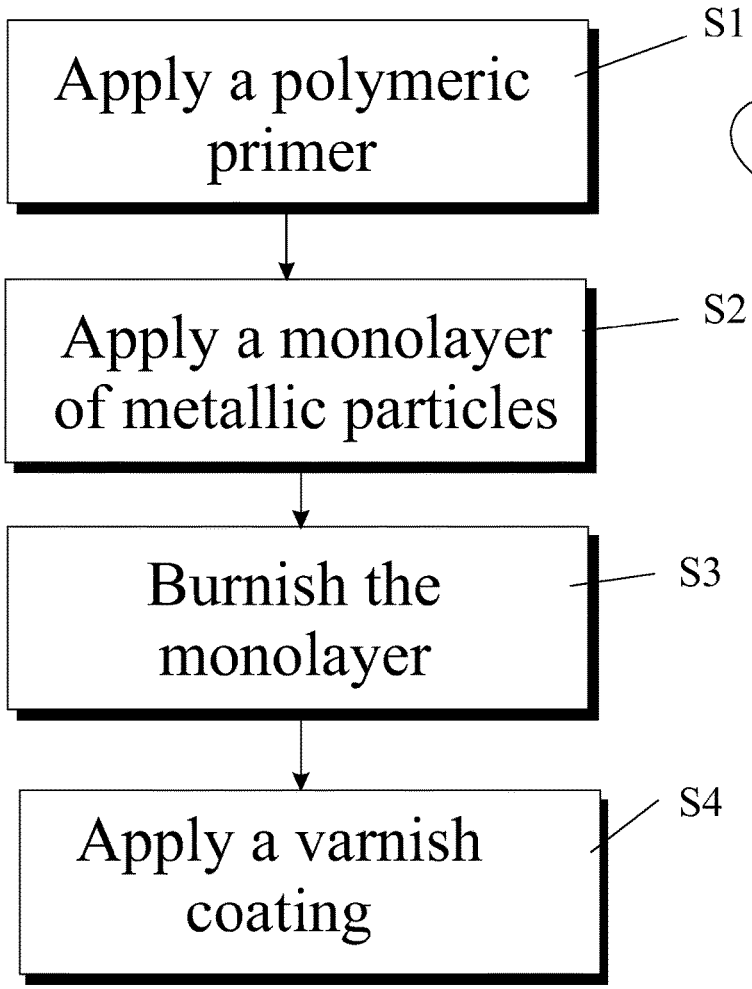
FIG. 3 is a chart showing the steps of a process used in producing the surface shown in FIGS. 1 and 2.

The steps of the process used to produce the surface are shown in FIG. 3 and will now be explained individually.

In step S1, it is ensured that the surface to be metallised is formed of a polymer that is suited to the process, such as a polyurethane, a polyurethane-silicone copolymer, a polyester or an acrylic polymer. If the surface is already made of such a polymer, then this step may not be required but more generally a base coat 12 will be needed. The base coat (which may be viewed as a polymeric primer) can be applied in the same way as conventional paints, for example by spraying (wet or dry), using a brush or a roller, or by dipping. The base coat can be applied in any suitable vehicle.

Without wishing to be bound by a particular theory, it is believed the hardness of the polymeric surface 10, optionally resulting from the application of the base coat 12, is lower than the hardness of the particles 20, so that the polymeric surface of the article to be coated can have enough contact with the particles to retain them. The surface energies of the particles and the polymeric surface may also be selected to ensure that the particles and the surface have an affinity for one another.

The polymer should be hydrophobic, that is to say the wetting angle with the aqueous carrier of the particles should be of substantially 90° or above. The wetting angle is the angle formed by the meniscus at the liquid/air/solid interface, and it is generally accepted that if it exceeds 90°, the liquid carrier (e.g., water-based) tends to bead and does not wet, and therefore does not adhere, to the surface. Such a lower limit is conventionally accepted for perfect theoretical conditions (e.g., the surface of the solid being chemically homogenous, topographically smooth and exactly horizontal, the liquid being devoid of any contaminant, and other such factors). However, the Inventors have found that systems having actual contact angles mildly lower than 90° can also display non-wetting behavior under various practical conditions for applying the fluid carrier and particles therein to the polymeric surface. Thus as used in the present description and appended claims a "wetting angle of substantially 90°" and the like is meant to encompass actual contact angles of at least 75°, at least 80°, at least 85°, and ideally at least 90° as measured on the polymeric surface In one embodiment, the actual contact angle being measured is the advancing contact angle.

The wetting angle or equilibrium contact angle $\Theta_0$, which is comprised between and can be calculated from the receding (minimal) contact angle $\Theta_R$ and the advancing (maximal) contact angle $\Theta_A$, can be assessed at a given temperature and pressure of relevance to the operational conditions of the process. It is conventionally measured with a goniometer or a drop shape analyzer through a drop of liquid having a volume of 5 μl, where the liquid-vapor interface meets the solid polymeric surface, at ambient temperature (circa 23° C.) and pressure (circa 100 kPa). Contact angle measurements can for instance be performed with a Contact Angle analyzer—Krüss™ "Easy Drop" FM40Mk2.

This hydrophobicity may be an inherent property of the polymer or may be enhanced by inclusion of hydrophobicity additives in the polymer composition.

The roughness or finish of the polymeric surface or base coat will be replicated in the metallised surface. If therefore a mirror finish is required, the polymeric surface or base coat would need to be polished to a high gloss finish, whereas for a satin finish the polymeric surface or base coat surface need not be polished or at least polished to the same degree of smoothness.

In step S2, a mosaic of metallic or metal-looking particles, that is to say particles having metal-like visual effect (e.g., reflectivity), is applied to the polymeric surface. The particles are generally in the low micronic or submicronic range, preferably "nano-particles" by which it is meant, when relating to platelets shaped particles, that their thickness is on average less than one micrometer (e.g., at most 1 μm, at most 800 nm, at most 600 nm, at most 500 nm, at most 400 nm, at most 350 nm, at most 300 nm, at most 250 nm, at most 200 nm, at most 175 nm, at most 150 nm, at most 125 nm, at most 100 nm or at most 80 nm) and optionally at least 5 nm, at least 7 nm, at least 10 nm, at least 15 nm, at least 20 nm, at least 25 nm, at least 30 nm, at least 40 nm, or at least 50 nm. The thickness of suitable particles is generally measured in no more than tens of nanometers (e.g., between 10 nm and 600 nm or between 20 nm and 500 nm). Especially if a mirror-like finish is required, the particles should be flat platelets, by which it is meant that their depth or thickness should be relatively small when compared with the mean diameter of the surface area that they cover, the aspect ratio being five, ten, twenty, thirty, forty, fifty or even more, the aspect ratio rarely exceeding a thousand. Thus a platelet particle having a thickness in the low nanometric range (e.g., 100 nm or less), may thanks to a high aspect ratio (e.g., 1:100 or more) have a representative planar dimension in the micronic range (e.g., 10-100 μm).

Since as mentioned the partial overlap of particles may result in the layer of particles having a thickness of up to three times the thickness of the particles forming it, the monolayer thickness can be at most 3 micrometers, at most 2.5 μm, at most 2 μm, at most 1.5 μm, at most 1 μm, at most 500 nm, at most 250 nm, at most 200 nm, at most 150 nm, at most 100 nm, or at most 50 nm. Generally, the thickness of the monolayer is between 10 nm and 1 μm or between 10 nm and 500 nm.

In addition to such partial overlaps between adjacent particles, each being at least partially in direct contact with the polymeric substrate, particles seemingly having no direct contact may occur. It must be recalled however, that such observations drawn while considering a particular section through the monolayer may not necessarily apply to other sections through a particle deemed to lack contact in another view. It is believed that a layer of particles coated according to the present teachings includes, by number, at most 35%, at most 30%, at most 25%, at most 20%, at most 15%, at most 10%, at most 7%, at most 5%, at most 3%, or at most 2% of particles not adhered or affixed to the polymeric surface, out of the total number of particles coating said surface (or a representative sample thereof).

The particles can be suspended in an aqueous carrier that is applied to the polymeric surface in a manner similar to the application of a conventional paint, such as by spraying, wiping, or using a brush or roller. During application, the liquid carrier does not adhere to the polymer on account of its hydrophobicity. However, the surface energies of the material of the particles and that of the polymeric surface being metallised are selected in such a manner that particles do adhere strongly to the polymer surface, coating it with a mosaic of particles. The particles on the other hand do not tend to stick to one another and therefore only particles in direct contact with the polymeric surface tend to adhere to it and others are dislodged, entrained and washed away by the strength of the spray jet or are physically displaced by a cloth, brush of roller (or a subsequent spray with water or any aqueous liquid lacking particles). This will leave behind only a monolayer of individual particles except perhaps for regions where edges of adjacent particles in contact with the polymeric surface overlap one another.

As mentioned, to facilitate the preferential affinity of the particles towards the polymeric surface being coated, and any step of the present method, the particles are advantageously hydrophobic. The hydrophobicity of the particles may be a known property inherent to their chemical composition. If needed, the degree of hydrophobicity or hydrophilicity can be assessed by measurement of the contact angle of a droplet of reference liquid (typically deionized water) on a sizeable surface of the bulk material forming the particles or of their coat, as applicable, such a method having been described in connection with the polymeric substrate. Additionally, hydrophobicity may be roughly assessed at the scale of the particles by introducing a predetermined amount of the particles into deionized water. Hydrophobic particles, if small, will display a leafing behavior, migrating towards the air interface, while hydrophilic particles will exhibit a non-leafing pattern, allowing them to maintain a fairly random distribution in the water carrier. Such phase separation, or lack thereof, can be facilitated by the addition of a non-water miscible oil phase, in which case the hydrophobic particles migrate towards the oil phase, while hydrophilic particles tend to remain in the aqueous phase. Additional methods can be used, such as surface adsorption assays using a known proportion of Rose Bengal dye per the amount of particles to be tested. The dye adsorbs on hydrophobic surface of particles as a function of their surface area. The unbound dye remaining in the aqueous phase can be measured by spectrophotometry, providing an estimate of the bound amount commensurate with the hydrophobicity of the particles. The relative hydrophobicity can be determined by calculating the Partition Quotient of the dye between the amount absorbed and the unbound amount. Similarly, Nile Blue dye can be used to determine the hydrophilicity of the particles surface. Additional methods are known and can be suitable. As used herein, the term "hydrophobic" and the like is used for particles and materials that exhibit hydrophobicity according to at least one (and preferably at least two or three) of the above-described characterization methods.

To achieve a mirror-like finish, the particle layer 14 formed in step S2 needs to provide a sufficient coverage of the surface and may, in step S3, be burnished. This operation may be performed by hand or using a motor driven polishing mop and its effect is to improve the even distribution and/or flatten the particles of the layer 14 into intimate contact with the surface of the base coat 12 or the surface 10 of the article if the latter is polymeric. The friction typically involved in such a case will also tend to break off overlapping regions of adjacent platelets to leave a layer that is formed of only a single thickness of the particles over at least 80%, at least 85%, at least 90%, or more preferably 95%, 97% or 99%, of its surface area. As mentioned, lower coverage of the polymeric surface by particles and/or lack of burnishing step may also be suitable, depending on the visual effect being sought.

The particle layer 14, whether burnished or not, can finally be coated with a protective clear varnish to improve its durability and resistance to scratching, as illustrated in step S4. The varnish adheres to the particles and holds them in position relative to each other and/or relative to the underneath polymeric surface. The varnish layer may itself be, if desired, tinted by addition of a colorant, to alter the appearance of the metallised surface, allowing it to resemble gold or copper plating as well as chrome or silver plating.

As so far described, a single coat of particles is applied to the polymeric surface but further effects can be achieved by repeating the process. In such a case, one would deposit a first particle coating and apply to it a clear coat of a polymeric material capable of accepting a second particle coating of the same or different particles. The second coating may be applied in a manner that intentionally allows part of the first particle coating to show through it or if the same particles are used for both coatings the mosaic a structure of the final finish will be less perceivable.

It should also be mentioned that in any one particle coating, all the particles need not be of the same material and indeed not all of them need to be metallic or metal-looking. A coating may further include particles that have similar physical properties to the metal particles, and will therefore form part of the same monolayer, but that comprise a polymeric binder and a pigment. Using such a mixture of particles, one can add glitter and pearlescence to an otherwise non-metallic finish.

The term "monolayer", is used herein to describe a layer in which—ideally—each particle has at least a portion that is in direct contact with the polymeric surface. While some overlap may occur between particles, the layer may be only one particle deep over a major proportion of the area of the surface. This occurs for the same reason that an adhesive tape, when used to pick up a powder from a surface, will only pick up one layer of powder particles. When the adhesive tape is still fresh, the powder will stick to the adhesive until it covers the entire tape surface. However, once the adhesive has been covered with powder, the tape cannot be used to pick up any more powder because the powder particles will not stick strongly to one another and can simply be brushed off or blown away from the tape. Similarly, the monolayer herein is formed from the particles in sufficient contact with the polymeric surface and is therefore typically a single particle thick.

Taking, for example, a platelet shaped particle contacting the polymeric surface over most of its planar face (e.g., being substantially parallel), the resulting thickness of the monolayer (in the direction perpendicular to the surface) would approximately correspond to the thickness of the particle, hence the average thickness of the monolayer can be approximated by the average thickness of the individual particles forming it. However, as there could be partial overlaps between adjacent particles, the thickness of the monolayer can also amount to a low multiple of the dimension of the constituting particles, depending on the type of overlap, for instance on the relative angles the particles may form with one another and/or with the polymeric surface and/or the extent of the overlap and the like. A monolayer may therefore have a maximum thickness (T) corresponding to about one-fold, or about two-fold, or about three-fold, or any intermediate value, of a thinnest characteristic dimension of the adhered particles. For flakes, platelets, and the like, the thinnest dimension is the particle thickness, while for generally spherical particles the "thinnest" dimension is essentially the particle diameter. Such dimensions are generally provided by the suppliers of such particles and can be assessed on a number of representative particles by methods known in the art, such as microscopy, including in particular by scanning electron microscope SEM (preferably for the planar dimensions) and by focused ion beam FIB (preferably for the thickness and length (long) dimensions). Such characteristic dimensions can be quantitatively determined for each particle or for the entire field of view of an image captured at relevant magnification.

Though the thickness of a single particle usually refers to its average thickness, platelet shaped particles typically display relatively homogeneous thicknesses across their planar dimensions, so that the maximum thickness of the particle can suitably approximate such characteristic dimension. When referring to a population of particles, the thickness of the particles can be estimated by the arithmetic mean of the maximum thicknesses of the particles forming the population, such values being typically measured only on a representative sample of the population.

For a relatively light effect or matte appearance, the area coverage by the mosaic of particles can be smaller (e.g., below 50%) than for glossy or mirror-like appearance. For such high gloss visual appearance, the mosaic of particles can sufficiently cover the target surface so that the reflection resulting from the particles applied to the polymeric substrate is suitable for the desired visual effect. For the same effect, and assuming all other parameters being equivalent, particles having a relatively higher reflectivity and/or more parallel orientation with the substrate may only need to cover a smaller percent area of the target surface than particles having a relatively lower reflectivity and/or a more random/less parallel orientation relative to the substrate. The relative reflectivity relates to the properties of the respective particles and can also be affected by the characteristics of the substrate and any such considerations readily understood by persons skilled in the art of metal coating. By "sufficient" covering, it is meant that the coat of particles on the relevant substrate regions will be devoid of defects perceptible to the naked eye, such as discontinuities or holes in the mosaic of particles that would expose the substrate surface to an extent visually detectable and detrimental to the intended visual effect. Having at least 50% of the area of the surface of the selected substrate region(s) to be coated, or at least 60%, or at least 70% of this area covered by particles may be sufficient coverage (i.e., providing for a sufficiently continuous layer of particles).

For high-end mirror-like appearance substantially the whole of the selected surfaces of the substrate to be coated may need to be covered. By "substantially" covering, it is meant that, as for sufficient covering, the coat of particles on the relevant substrate regions will be devoid of visible defects, such as discontinuities or holes in the mosaic of particles that would expose the substrate surface to an extent detectable by the naked eye. Having at least 80% of the area of the surface of the selected substrate region(s) to be coated by particles, or at least 85%, or at least 90% or at least 95% of the area covered by particles is considered a substantial coverage (i.e., providing for a substantially continuous layer of particles). This results in a glossy or shinny visual effect.

For lower-end effect, or for visual effects such as sparkles, glitters and pearlescence, an area coverage of less than 50% can be satisfactory. Thus depending on the desired visual effect and on the particles involved, a monolayer of up to 50% area coverage can be used according to the present teachings.

The percentage of an area covered by particles out of a specific target surface can be assessed by numerous methods known to skilled persons, including by determination of optical density possibly in combination with the establishment of a calibration curve of known coverage points, by measurement of transmitted light if either the particles or the substrate are sufficiently transparent, or conversely, by measurement of reflected light, for instance if the particles are reflective. Determination of the percentage area of a substrate covered by particles can be performed by microscopy and image analysis of representative fields of view of the surface of interest. Depending on the particles and the substrate, the images can be captured in reflectance or transmittance mode, displaying the image in gray scale (e.g., 8-bit) permitting to differentiate between particles and interstices according to a threshold value, the determination of which (typically suggested by the image analysis program) allows calculating the percent area of coverage which can also be expressed as a ratio.

For matte visual effects, the particle can be selected to provide such a look (e.g., having a matte outer surface or having a non-platelet shape) or can be oriented on the polymeric substrate in a manner providing such an effect. As readily understood, particles being non-parallel with the surface of a substrate, even if being reflective, may diffract light in a way resulting in an overall matte effect. A matte effect can therefore be achieved by using a substrate having a relatively rough surface. If needed, a base coat having a rough surface can be applied to hamper parallel orientation of the particles to the substrate, facilitating the provision of a matte appearance. As discussed, polymeric surface having a relatively low hardness may promote such a matte effect.

Additional visual effects can include metallescent effect, pearlescent effect, iridescent effect, sparkling effect, glittering effect and like "optical effects" that may result from any type of light reflection, diffraction and interference, as the case may be. All such visual effects can be derived, among other factors, from the very nature of the particles being used (e.g., their surface reflectivity to light), from their shape, their dimensions, their size distribution, their loading in the coating fluid, their orientation on the substrate and/or their density thereon. Such considerations are known to the skilled person and need to be further detailed.

While the process has been described by reference to a particular embodiment, it will be appreciated that the person skilled in the art may make various modifications without nevertheless departing from the scope of the appended claims.

For example, while the polymeric material has been described as hydrophobic and the liquid carrier of the particles as being aqueous, it would instead be possible to use any combination of polymer and carrier liquid, so long as the wetting angle between them exceeds 90°.

In the description and claims of the present disclosure, each of the verbs "comprise", "include" and "have", and conjugates thereof, are used to indicate that the object or objects of the verb are not necessarily a complete listing of features, members, steps, components, elements or parts of the subject or subjects of the verb. These terms encompass the terms "consisting of" and "consisting essentially of".

As used herein, the singular form "a", "an" and "the" include plural references and mean "at least one" or "one or more" unless the context clearly dictates otherwise.

Positional terms such as "upper", "lower", "right", "left", "bottom", "below", "underneath", "beneath", "lowered", "low", "top", "above", "elevated", "high", "vertical", "horizontal", and the like, as well as grammatical variations thereof, may be used herein for exemplary purposes only, to illustrate the relative positioning or placement of certain components, to indicate a first and a second component in present illustrations or to do both. Such terms do not necessarily indicate that, for example, a "bottom" component is below a "top" component, as such directions, components or both may be flipped, rotated, moved in space, placed in a diagonal orientation or position, placed horizontally or vertically, or similarly modified, for instance depending on the shape of the article to be coated and on the orientation in space of the polymeric surfaces to which instant process can be applied.

Unless otherwise stated, the use of the expression "and/or" between the last two members of a list of options for selection indicates that a selection of one or more of the listed options is appropriate and may be made.

As used herein, unless otherwise stated, adjectives such as "substantially" and "about" that modify a condition or relationship characteristic of a feature or features of an embodiment of the present technology, are to be understood to mean that the condition or characteristic is defined to within tolerances that are acceptable for operation of the embodiment for an application for which it is intended, or within variations expected from the measurement being performed and/or from the measuring instrument being used. As used herein, when a numerical value is preceded by the term "about", the term "about" is intended to indicate +/−10% or even only +/−5%, and in some instances the precise value.

The invention claimed is:

1. A process for metallising a polymeric surface of an article, which process comprises contacting the polymeric surface with a liquid carrier containing a suspension of metallic or metal-looking particles, wherein the polymeric surface and the liquid carrier are such that the wetting angle between the liquid carrier and the polymeric surface on the article is of substantially 90° or above, and wherein the particles and the polymeric surface are such that the particles have a greater affinity to the polymeric surface than to one another or to the liquid carrier, whereby particles suspended in the liquid carrier migrate to the interface between the liquid carrier and the polymeric surface to form a monolayer coating of particles on the polymeric surface.

2. A process as claimed in claim 1, wherein the particle are platelets.

3. A process as claimed in claim 2, wherein the platelets have a thickness that is five times smaller than their mean diameter.

4. A process as claimed in claim 1, wherein the particles have a thickness of less than 1 micrometer.

5. A process as claimed in claim 1, wherein the particles have a thickness between 10 nm and 600 nm.

6. A process as claimed in claim 1, wherein the surface to be metallised is that of an article that has been moulded from a polymeric material.

7. A process as claimed in claim 1, wherein a polymeric base coat is applied to the article, prior to the surface being coated with metallic or metal-looking particles.

8. A process as claimed in claim 1, wherein the liquid carrier of the metallic or metal-looking particles is aqueous and the polymeric material of the article is selected to be hydrophobic.

9. A process as claimed in claim 8, wherein the hydrophobicity of the polymeric material results from inclusion of an additive in a polymer composition.

10. A process as claimed in claim 9, wherein the additive is selected from the group consisting of synthetic, natural, plant and mineral oils, waxes, plasticizers and silicone additives.

11. A process as claimed in claim 1, wherein the particles comprise at least one of a metal selected from the group consisting of aluminum, copper, gold, iron, nickel, tin, titanium, silver and zinc; a metal alloy selected from the group consisting of steel, brass and bronze; and mica.

12. A process as claimed in claim 11, wherein the particles have a surface coating.

13. A process as claimed in claim 12, wherein the surface coating of the particles comprises an acid selected from the group consisting of a carboxylic acid and a fatty acid.

14. A process as claimed in claim 1, wherein the polymeric material is selected from the group consisting of a polyurethane, a polyurethane-silicone copolymer, a polyester and an acrylic polymer.

15. A process as claimed in claim 1, wherein the particles form a layer on the polymeric surface, which layer is burnished during or subsequent to its application to the polymeric surface.

16. A process as claimed in claim 1, wherein a clear varnish coat is applied over the monolayer coating of particles.

17. A process as claimed in claim 16, wherein the varnish coat includes a colorant.

18. A process as claimed in claim 1, wherein the monolayer coating of particles covers at least 80% of the area of the polymeric surface upon which it is applied.

19. A process as claimed in claim 1, wherein the monolayer coating of particles has a thickness between about 10 nm and about 1 μm.

20. A process as claimed in claim 1, wherein the monolayer applies to the polymeric surface a visual effect selected from the group consisting of glossy, shiny, matte, sparkling, glittering, pearlescent, iridescent and metallescent.

* * * * *